United States Patent [19]

Corain et al.

[11] Patent Number: 4,763,699

[45] Date of Patent: Aug. 16, 1988

[54] SYSTEM OF DETECTION OF SHED CLOSED TO SHUTTLE PASSAGE IN MULTI-STEP TEXTILE LOOMS

[75] Inventors: Luciano Corain; Gianni Maitan, both of Vicenza; Giulio Bortoli, Schio, all of Italy

[73] Assignee: Nuovo Pignone Industrie Meccaniche e Fonderia S.p.A., Florence, Italy

[21] Appl. No.: 77,223

[22] Filed: Jul. 24, 1987

[30] Foreign Application Priority Data

Jul. 30, 1986 [IT] Italy ..... 21311 A/86

[51] Int. Cl.[4] ..... D03D 47/26

[52] U.S. Cl. ..... 139/436; 139/371; 139/344; 139/196.3

[58] Field of Search ..... 139/436, 344, 371, 196.3

[56] References Cited

U.S. PATENT DOCUMENTS 3,880,197 4/1975 Bucil et al. ..... 139/436
3,933,183 1/1976 Mateju et al. ..... 139/196.3
3,933,184 1/1976 Mateju et al. ..... 139/196.3
4,135,556 1/1979 Santucci et al. ..... 139/436

*Primary Examiner*—Henry S. Jaudon
*Attorney, Agent, or Firm*—Hedman, Gibson, Costigan & Hoare

[57] ABSTRACT

System of detection of a shed closed to passage of a shuttle in a multi-phase weaving textile loom. This invention is comprised of the following: sensitive control bars made elastically movable along the vertical direction, with a stroke at least equalling the vertical shift necessary for the shuttle roller to disengage from the corresponding thrust roller of the dragging chain of the same shuttle; two adjoining sensitive control blades, both are on the rotary-reed facing divergent side wall of each shuttle; the outward blade is fixed and rigid while the longer inward blade is rotatable around a vertical axis; and upon detection of a persistent entanglement by the control blades, a lever pin, kept in a retracted position by a retainer hook, is freed by movement of the retainer hook such that the lever pin springs outwards to protrude from the shuttle plane, pressing upon a sensitive control bar, generating a stop loom signal.

6 Claims, 4 Drawing Sheets

SYSTEM OF DETECTION OF SHED CLOSED TO SHUTTLE PASSAGE IN MULTI-STEP TEXTILE LOOMS

BACKGROUND OF THE INVENTION

The present invention relates to a new system of detection of entanglements of warp threads across a shed that closes the shed to the passage of a shuttle in a multi-phase weaving textile loom. This new system, being endowed with characteristics of differential sensitivity, and of memorization of the signalling of the entanglement position, secures an efficacious and optimum operation of the loom, with its immediate stopping only in strictly necessary cases.

It is known that the hindrances or obstacles which the shuttle can meet during its run through the shed (formed by the warp threads in a multi-step loom) are of three types, viz., namely, unstable entanglements of weakly entangled threads, weak but persistent entanglements which are not loosened by the shuttle passage, and strong entanglements.

A system of detection of a closed shed, for supplying an optimum performance, should hence be able to filter the above said faults. Such a system should not stop the machine in the presence of unstable weak entanglements which are opened by the passage of the same shuttle, but signal the persistent entanglements stopping the loom, and stop the machine as immediately as possible in the presence of strong entanglements. Furthermore, the system should be also provided with a permanent memory of the signalling of persistent entanglements, for the purpose of securing the looming stoppage even if the instantaneous transmission of the stop signal is hindered by a particular and contingent arrangement of the warp threads.

From the prior art, different types of detection systems are already known, but none of these systems are able to fulfill the above-said requirements.

In fact, the known system of exploiting the increase in the resistance to the shuttle running caused by an obstacle present across the shed, such as, e.g., a strong entanglement of warp threads, has major drawbacks. This system reacts to a strong entanglement of warp threads by causing the shuttle to be more pressed against a sensitive control bar, which thus interrupts the electrical system of control of the loom and stops this latter. In addition to not enabling the operator to detect the possible weak persistent entanglements, with the consequent production of faulty fabrics, this prior art system has the drawback that, due to the natural delay in loom stopping relative to the entanglement presence signal, the shuttle continues to press against the obstacle present inside the shed, with the possibility that the warp thread mey get broken before the loom is stopped.

Another system of the prior art, consisting in providing a side wall of the shuttle with a sensitive control elastic blade controlling the tranducers which supply the loom stopping signal has the drawback of a delayed action in that, when the blade detects the presence of an obstacle, the shuttle has already penetrated, by a large portion of its length, into the defect, possibly causing the fabric under way of formation to be irretrievably damaged. Furthermore, the adjustment of the stiffness of said elastic blade is very difficult to gauge in that it is requested to fulfill opposite needs, viz., it should be not too sensitive, so to be able to loosen the unstable entanglements without stopping the loom. And it should be, at the same time, very sensitive, so to be able to signal the persistent entanglements.

In practice, an intermediate stiffness is adopted, so that often useless stops of the loom occur, because of the (not too low) sensitivity of the blade.

Finally, none of the known systems is provided with a memory of the stop signal.

SUMMARY OF THE INVENTION

The purpose of the present invention is precisely that of obviating the above-said drawbacks by supplying a detection system that efficaciously and immediately signals the preserved persistent entanglements that immediately stops the loom in the presence of strong entanglements, that stops the loom for the least indispensable time and that memorizes the generating of any loom stop signals.

That purpose is substantially achieved by providing each shuttle with a side profile having two different-sensitivity zones.

More specifically, the divergent side wall on the rotary reed-facing side of the shuttles is equipped with two adjoining sensitive control blades, which protrude and diverge beyond the same side wall, from the opposite side relative to the shuttle point. The outward blade relative to the rotary reed-facing side, is rigid and stationary, and the inward blade of which is movable around a vertical rotation axis and is kept resting against the said outward blade by a spring, said inward blade being longer than the outward blade. The inward blade has a retainer hook at the end of an appendage. The retainer hook holds a lever pin in a retracted position within a hollow section of the shuttle, the lever pin being hinged on a horizontal pivot. Upon release of the lever pin by the retainer hook, a spring acts upon said lever pin so that the lever pin protrudes from the top plane of the shuttle, thereby pressing against the sensitive control bar.

Because of its stiffness, the outward blade, being rigid and stationary, is efficacious for the disentangling of weak and unstable entanglements. Such entanglements are generally disentangled by the passage of the outward blade (as part of the shuttle) through the shed. Thus, the outward blade reduces the number of loom stops caused by weak and unstable entanglements. Furthermore, the outward blade extends the operative zone of disentangling by becoming an addition to the side wall of the shuttle, i.e., adding the length and divergence of the outward blade to the side wall.

The inward blade, which extends lengthwise beyond the outward blade, is, on the contrary, efficacious for the detection of persistent entanglements, in that it allows the loom to be stopped in the presence of entanglements constituted by a few (generally two) warp threads, which are not loosened by the progressing of the shuttle, and of the said outward blade, through the shed.

The said stoppage is caused by the persistent entanglement itself, which, in as much as it was not previously loosened by the action of the outward stationary blade, comes to press against the inward, movable, blade which, in its outer portion, protrudes beyond the inward blade. Rotation of the inward blade by the press of the persistent entanglement releases from its retainer hook the lever pin, which thus springs outwards, by being so urged by its spring, and comes to interact with a sensitive control bar which in its turn closes the excitation circuit of the transducers supplying the loom stop signal.

On the other hand, one should keep in his mind that, due to the fact that the lever pin, once sprung, remains protruding out of the shuttle surface, and hence remains in its active position relatively to the sensitive control bars. Thus the system of the present invention memorizes the need for a loom stopping, the loom stopping is anyway secured even if warp threads exist, which prevent an instantaneous transmission of the stop signal.

Finally, the strong and resistant entanglements are detected by a shuttle section, starting from its point up to the free end of the said outward, rigid blade, which, when does not find a corresponding opening of the shed, stops the loom in cooperation with the said sensitive control bars which constitute the upper guide elements for the shuttles.

Another improvement over the prior art involves the mobile characteristic of the sensitive control bars. In prior art systems, during the necessary time for the loom to stop, the shuttle may continue to act on the obstruction existing across the shed, with the consequent possible breakage of the warp threads. But according to another characteristic of the present invention, said sensitive control bars are provided as elastically movable along a vertical direction, with a stroke at least equalling the vertical shift necessary for the shuttle roller to unhook from the corresponding thrust roller of the dragging chain.

In such a way, in fact, the increase in resistance to the running of the said shuttle, caused by the obstacle existing across the shed, such as a strong thread entanglement, causes a disengagement, now made possible, of the shuttle, from the corresponding thrust roller of the dragging chain which, by travelling beyond the roller of the same shuttle, causes the shuttle to be lifted, with the consequent lifting of the related sensitive control bar in the direction opposite to the action of its return springs. Hence, such lifting closes the electrical circuit which controls the loom stopping. Summing up, the strong entanglement stops immediately the shuttle and pushes it vertically upwards, together with the overhanging sensitive bar, whilst the dragging chain continues running until the loom stops.

BRIEF DESCRIPTION OF THE DRAWING

The invention is now explained referring to the drawings, which illustrate a preferred embodiment of the invention, provided for exemplifying and not limiting the invention.

In said drawings.

DESCRIPTION OF THE PREFERRED EMBODIMENT

Figure 5:
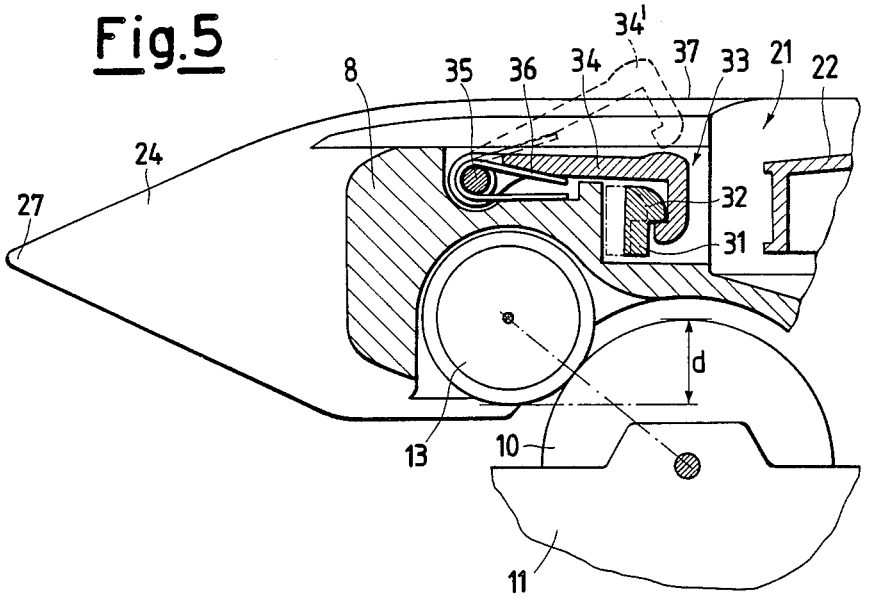
FIG. 5 shows a partial side sectional view on a different scale, taken according to CC path of FIG. 4.

Referring to the Figures, there is shown a rotary reed 1 of a multi-phase weaving loom 12, and heddles 2', which are positioned behind the stationary reed 2, and which, by acting on the warp threads 3 and 3', generate the different sequential sheds 4, 5, 6, . . . , inside which the shuttles 7, 8, 9, . . . , respectively run, by being dragged into them by the thrust rollers 10, mounted idle on a dragging chain 11 sliding inside a suitable guide provided on loom 12. Such thrust rollers 10 cooperate with the rollers 13, which are, in their turn, mounted idle on the same shuttles. The shuttles are furthermore guided on their upper part, inside the sequential sheds, by sensitive control bars 14, 15, 16, . . . , which are inserted inside a suitable reverse-"U"-shaped guide 17 integral with the loom 12. The sensitive control bars are vertically movable, and are elastically pressed onto the same shuttles by being so urged by the springs 18. The structure is such that the bars 14, 15, 16, . . . can shift by a vertical stroke at least equal to the vertical shift d (see FIG. 5) necessary for the roller 13 of the shuttle to get disengaged from the corresponding thrust roller 10 of the dragging chain 11.

At the end of said shift, the bars press switch member 19 which close the circuit of excitation of the transducers 20 which supply the loom stopping signal. In this way, the presence of a strong entanglement blocks immediately the related shuttle, because this latter can move up and consequently allow the thrust roller to pass; moreover, this moving up of the shuttle, and, consequently, of the sensitive bar, causes switch member 19 to trip and, hence, stopping the loom.

Figure 1:
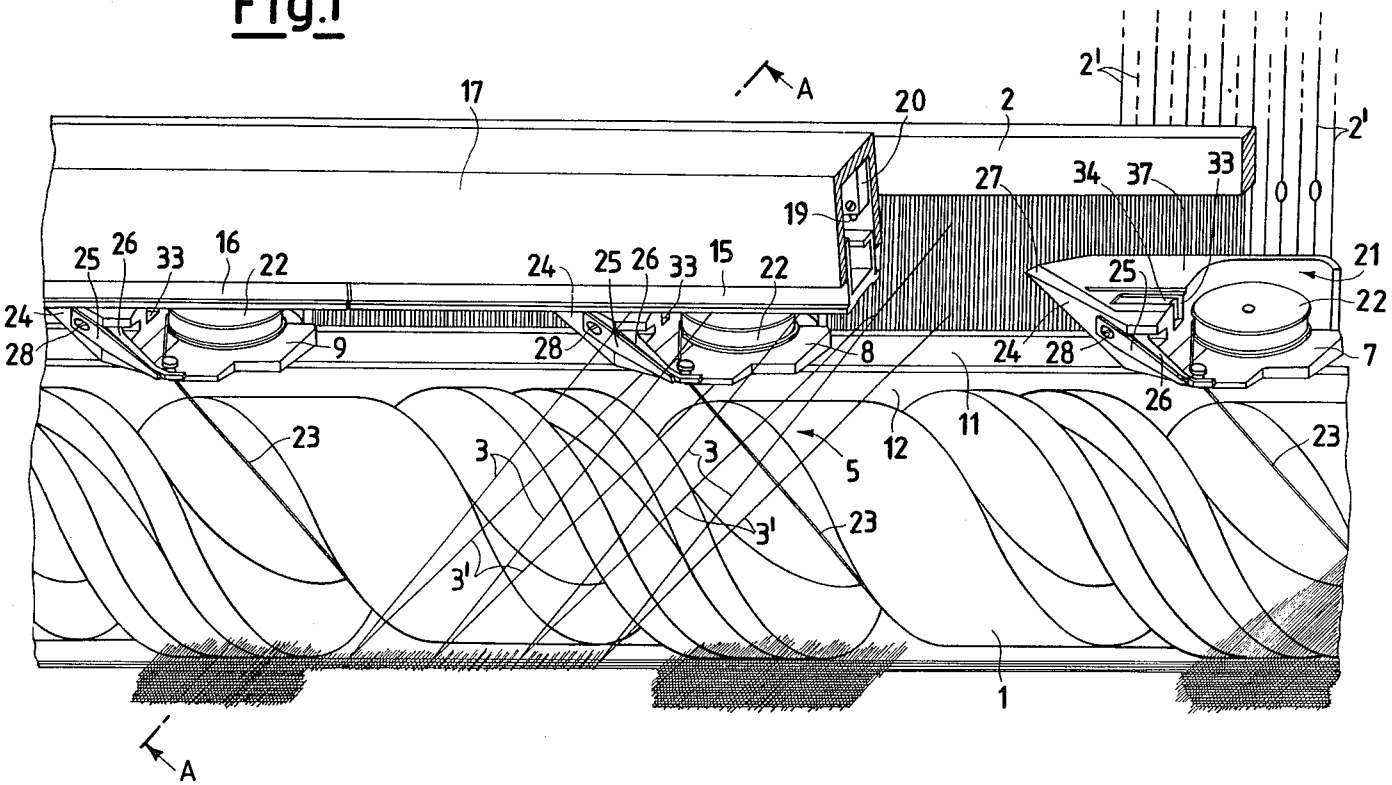
FIG. 1 shows a partial perspective and sectional view of a multi-phase weaving loom adopting the system of closed shed detection according to the present invention.
Figure 2:
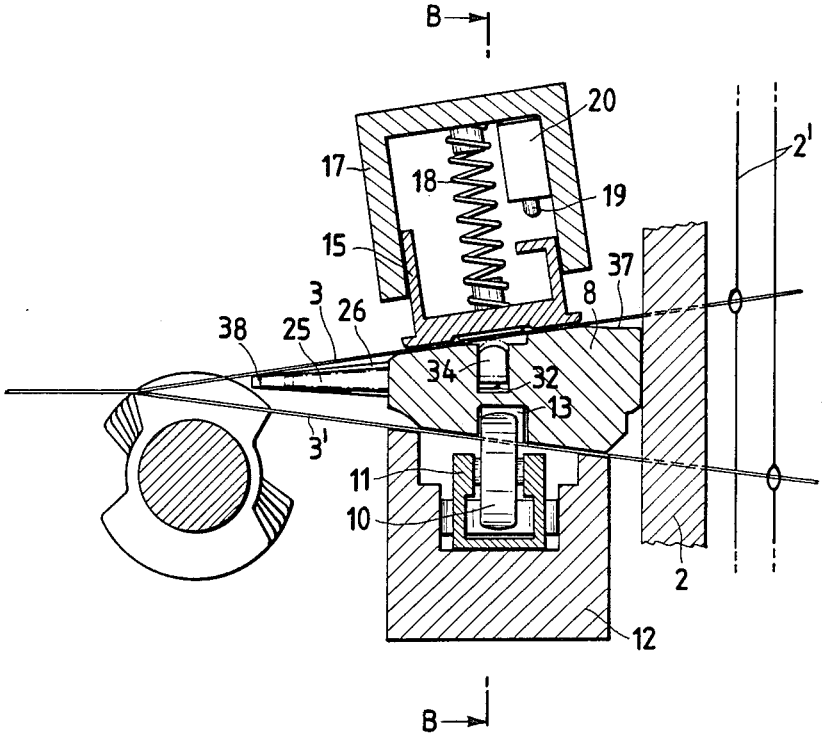
FIG. 2 shows a cross-sectional, enlarged-scale view taken along AA path of FIG. 1.
Figure 3:
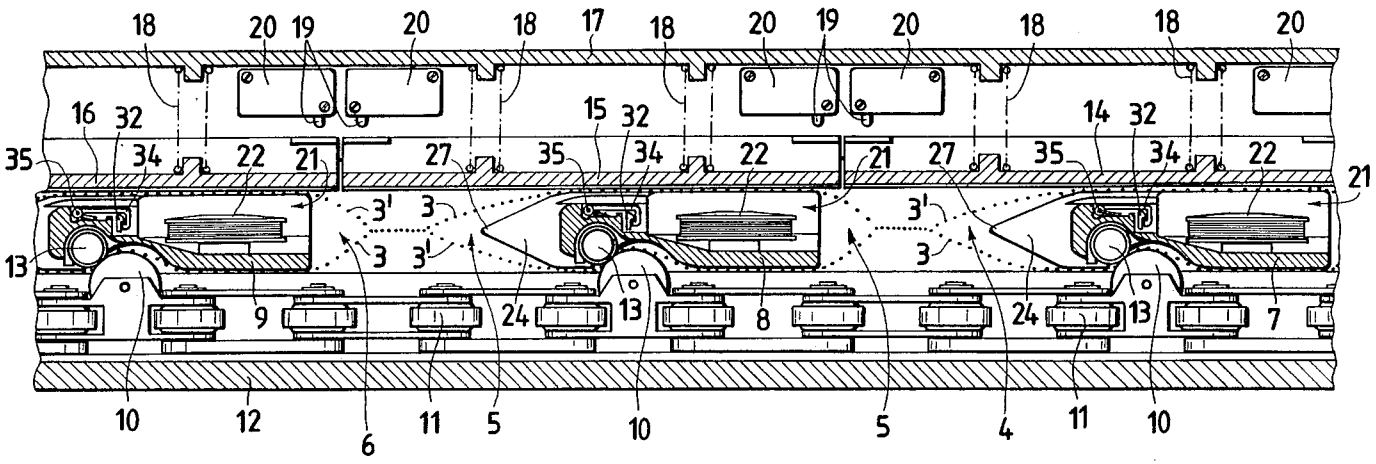
FIG. 3 shows a longitudinal-sectional view, on a different scale, taken along BB path of FIG. 2.
Figure 4:
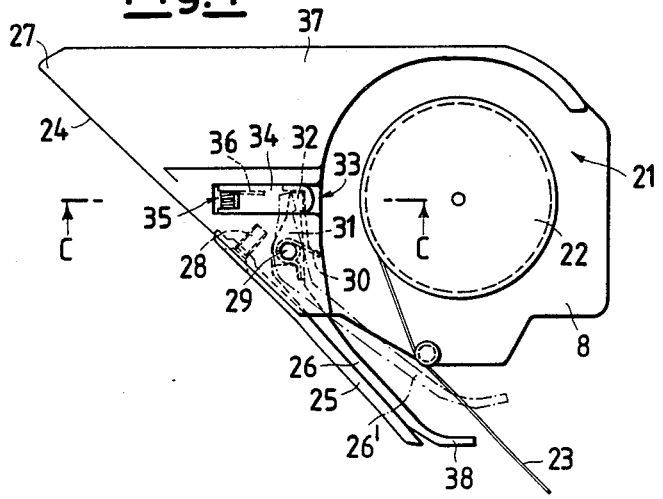
FIG. 4 shows a top view, on an enlarged scale, of a shuttle used on the multi-phase weaving loom of FIG. 1.

Each shuttle 7, 8, 9, . . . , having a substantially triangular pointed shape, with a hollow 21 housing the the weft yarn 23 feeding bobbin 22, is furthermore provided, on its divergent side wall, on the rotary reed-facing side, 24 (see specifically FIG, 1), with two sensitive control blades 25 and 26, adjoining each other, which extend and diverge beyond the same side wall, from the opposite side relatively to the point 27 of the same shuttle. The outward blade 25, relative to the rotary reed 1 facing side, (see specifically FIG. 1), is rigid, and is fastened onto said side wall 24 by means of screws 28. The inward blade 26, on the contrary, is movable around the vertical rotation axis 29 (see FIG. 4) and is kept resting against the outward blade 25 by being so urged by a spring 30. Said inward blade 26 has an appendage 31 provided with a retainer hook 32 (see specifically FIG. 5), which holds, in a retracted position inside a suitable hollow 33 of the shuttle 7, 8, 9, . . . (see always FIG. 5), a lever pin 34, hinged on a horizontal pivot 35. A spring 36 urges said lever pin to rotate so as to protrude from the top plane 37 of the same shuttle (as shown in short-dash lines, and indicated by the numeral 34' in FIG. 5), thereby pressing against the sensitive control bars 14, 15, 16, . . . . Finally, the inward blade 26 is longer than the outward blade 25, so that the inward blade 26 protrudes beyond the outward blade 25 by the length 38 (see FIGS. 2 and 4), which is the element sensitive to the persistent entanglements. By coming into contact with length 38 of the inward blade 26, a persistent entanglement, i.e., an entanglement that is not completely loosened by the passage of the divergent side wall 24 of the shuttle and of its extension constituted by the rigid outward blade 25, causes the inward blade 26 to rotate to the position as indicated by position 26′ (see FIG. 4). The rotation of the inward blade 26 to position 26′ upon contact with a persistant entanglement initiates the following chain of events: the unhooking of lever pin 34 which then comes to protrude the position 34′ (see FIG. 5), thereby pushing upwards the corresponding sensitive control bar, generating the signal that stops the loom.

We claim:

1. A system for the detection of a shed closed by a persistent entanglement to passage of a shuttle in multiphase weaving type textile looms comprising:

(a) a plurality of shuttles, each shuttle being provided in its bottom portion with a roller;

(b) the roller of each shuttle cooperates with a corresponding thrust roller of a dragging chain;

(c) a plurality of control bars that guide said shuttles on their upper portion, said control bars and shuttles being elastically moveable along a vertical direction;

(d) two adjoining control blades, an inward rotatable blade and a shorter rigid and stationary outward blade, both located on a divergent side wall of each shuttle on a rotary reed-facing side thereof, wherein said inward control blade is maintained against the outward control blade by a spring;

(e) a rotatable lever pin held in a retracted position within each shuttle such that movement of the inward control blade upon engagement of a persistent entanglement frees the rotation of said lever pin, whereupon the lever pin protrudes from the shuttle, thereby pushing a corresponding control bar upwards; and (f) means operatively connected to the loom for converting the upward movement of said control bars into a loom stop signal.

2. The system of claim 1 wherein each shuttle is triangularly shaped.

3. The system according to claim 1 wherein shifting means shifts said shuttle and corresponding control bar by at least a vertical stroke necessary for a roller of said shuttle to become disengaged from a corresponding thrust roller of a dragging chain.

4. The system of claim 1 wherein said means of converting the upward movement of said control bars into a loom stop signal comprises an excitation circuit of a transducer.

5. The system of claim 1 wherein said inward control blade has at one end a retainer hook as an appendage, the retainer hook controlling rotation of said lever pin.

6. The system of claim 1 wherein said outward rigid control blade engages and frees weak entanglements without causing loom stoppage by movement of said inward control blade.

* * * * *